US007182577B2

(12) United States Patent
Yamashita et al.

(10) Patent No.: US 7,182,577 B2
(45) Date of Patent: Feb. 27, 2007

(54) TURBINE ROTOR BLADE AND TURBINE

(75) Inventors: Yutaka Yamashita, Hitachi (JP); Eiji Saitou, Hitachi (JP); Kiyoshi Namura, Tokai-mura (JP); Hideo Yoda, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/211,519

(22) Filed: Aug. 26, 2005

(65) Prior Publication Data

US 2006/0177314 A1 Aug. 10, 2006

(30) Foreign Application Priority Data

Sep. 16, 2004 (JP) ..... 2004-269254

(51) Int. Cl.
*F01D 5/22* (2006.01)

(52) U.S. Cl. ..... 416/191; 416/219 R; 29/889.21

(58) Field of Classification Search ..... 416/189, 416/190, 191, 195, 196 R, 219 R, 220 R, 416/221; 29/889.21
See application file for complete search history.

(56) References Cited

U.S. PATENT DOCUMENTS

2004/0165989 A1 8/2004 Caruso et al.

FOREIGN PATENT DOCUMENTS

JP 01087804 A * 3/1989
JP 05-098906 4/1993

* cited by examiner

*Primary Examiner*—Richard A. Edgar
(74) *Attorney, Agent, or Firm*—Mattingly, Stanger, Malur, Brundidge, P.C.

(57) ABSTRACT

A set of turbine rotor blades is arranged on a rotor disk. Each rotor disk has blade profile, root parts which is fitted axially in an axial disk groove formed circumferenctially in the rotor disk, and an integral cover formed at the outer edge of the blade profile part. A front end surface, faced in a direction the rotor disk rotates, of the integral cover is inclined to a direction in which the root part of the turbine rotor blade is fitted in the disk groove of the rotor disk. The sum of circumferential lengths of the integral covers is greater than a circle at which the integral covers are joined to the blade profile parts. Adjacent integral covers are brought into contact with each other by the blade profile parts that are twisted when root parts of the turbine rotor blades are fitted axially in the disk grooves.

13 Claims, 7 Drawing Sheets

$$Z = (P+X)\tan\alpha = X\tan\beta$$

$$Z = (P\tan\alpha\tan\beta) / (\tan\beta - \tan\alpha)$$

TURBINE ROTOR BLADE AND TURBINE

BACKGROUND OF THE INVENTION

1. Field of the Invention

The present invention relates to a turbine, such as a gas turbine or a steam turbine, and a turbine rotor blade for the turbine.

2. Description of the Related Art

Turbine rotor blades of gas turbines and steam turbines are continuously excited for vibrations of frequencies in a wide frequency range by turbulent components of a working fluid. The vibratory response of a blade structure to excitation is influenced by the magnitude of excitation and damping for natural free vibration frequency in each mode of vibration. To improve the reliability of blades, a blade connecting structure is employed to connect the adjacent blades so that resonance may be avoided in a lower order vibration mode in which vibration response, in generally, is high and vibration response may be low in a higher degree vibration mode in which vibration response is low even if resonance occurs.

A blade connecting structure includes connecting covers, namely, integral covers, attached to the outer edges of blade profile parts so as to extend in the revolving direction of the blades so that the integral covers of the adjacent blades are in contact with each other. This blade connecting structure has high reliability owing to the high strength, which withstands centrifugal force, of the integral covers and the high vibration damping effect of friction between the adjacent integral covers.

When a blade connecting structure including integral covers is applied to turbine rotor blades having a short blade length, it is possible that the adjacent integral covers are separated from each other because the blade profile parts are twisted slightly by centrifugal force that acts on the blades during operation and thermal expansion. Therefore, in a blade connecting structure disclosed in JP-A No. 5-98906 (Patent document 1), the end surfaces, facing in the rotating direction, of the integral covers are inclined to the axis of the turbine, and the integral covers are formed in a circumferential length greater than a length obtained by dividing the circumference of a circle passing the radial positions of the integral covers by the number of blades (hereinafter referred to as "geometrical length"). Thus the integral covers of the adjacent blades are connected firmly by reaction force acting on the blades assembled so as to press each other.

Some turbine rotor blade is attached to a rotor disk of a turbine rotor by pressing the turbine rotor blade in an axial disk groove formed in the turbine disk. When the foregoing blade connecting structure is applied to the turbine rotor blades of this type, integral covers attached to the turbine rotor blades interfere with each other and the turbine rotor cannot be assembled because the length of the integral covers are greater than the geometric length. Generally, the turbine rotor blades are bent so that the integral covers may not interfere with each other when the turbine rotor blades are attached to the rotor disk. Consequently, it is very difficult to assemble the turbine rotor and a high stress is induced in the root part of the turbine rotor blade and the edge of the disk groove of the rotor disk by reaction force acting on the root part of the turbine rotor blade when the turbine rotor blade is attached to the rotor disk. After a turbine rotor has been assembled, the turbine rotor blades attached to the rotor disk twist and reaction force acts on the root parts of the turbine rotor blades. A high stress induced in the root part of the turbine rotor blade that retains the turbine rotor blade on the rotor disk against centrifugal force that acts on the turbine rotor blade during operation and edges of the disk groove in engagement with the root part of the turbine rotor blade will cause a problem in the strength of the turbine rotor that rotates at a high rotating speed.

SUMMARY OF THE INVENTION

Accordingly, it is an object of the present invention to provide a highly reliable turbine rotor blade having a short blade length, ensuring the satisfactory connection of adjacent integral covers, facilitating assembling work and capable of reducing stress that may be induced in its root part and to provide a turbine provided with such turbine rotor blades.

The present invention provides a set of turbine rotor blades arranged in a circular cascade on a rotor disk, each having a blade profile part, a root part to be fitted axially in one of a plurality of axial disk grooves formed in the rotor disk in a circumferential arrangement, and an integral cover formed integrally with the blade profile part at the outer edge of the blade profile part; wherein a front end surface, faced in a direction in which the turbine rotor blades revolve, of the integral cover is inclined to a direction in which the root part of the turbine rotor blade is fitted in the disk groove of the rotor disk, the sum of the circumferential length of the integral covers of the turbine rotor blades is greater than a circumference of a circle passing positions at which the integral covers are attached to the outer edges of the blade profile parts, and the adjacent integral covers are brought into firm contact with each other by the resilience of the blade profile parts which are subject to torsional deformation when the root parts of the turbine rotor blades are fitted axially in the disk grooves of the rotor disk.

Although the turbine rotor blades of the present invention are short, the adjacent integral covers can be kept in close contact with each other while the turbine rotor is being assembled and while the turbine rotor is in operation, the turbine rotor can be easily assembled, high stress will not be induced in the root parts of the turbine rotor blades and in edges of the disk grooves of the rotor disk in engagement with the root parts of the turbine rotor blades and the turbine rotor blades form a highly reliable turbine rotor blade structure.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Turbine rotor blades in preferred embodiments according to the present invention will be described with reference to the accompanying drawings.

Figure 1:
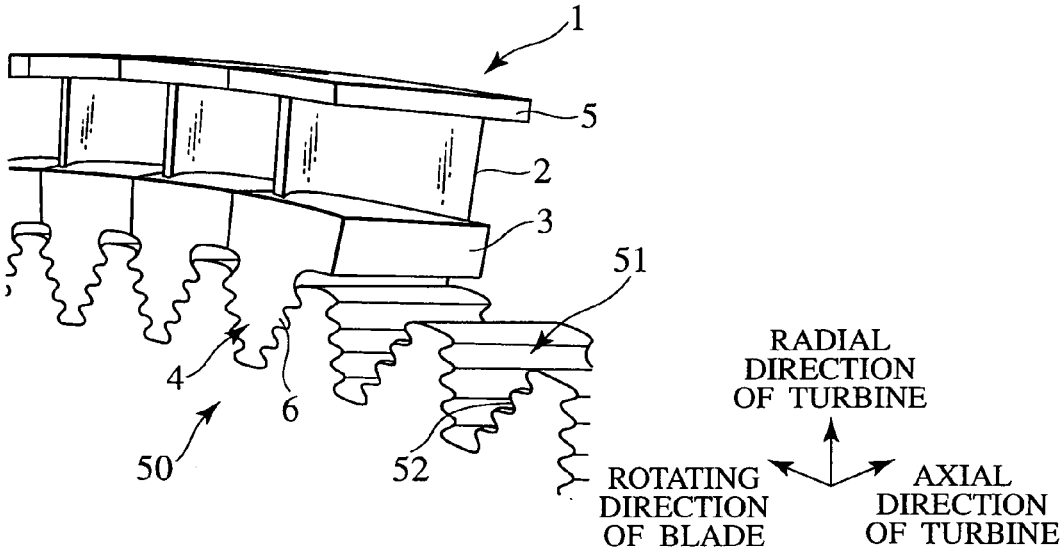
FIG. 1 is a fragmentary perspective view of a circular cascade including turbine rotor blades in a first embodiment according to the present invention.
Figure 2:
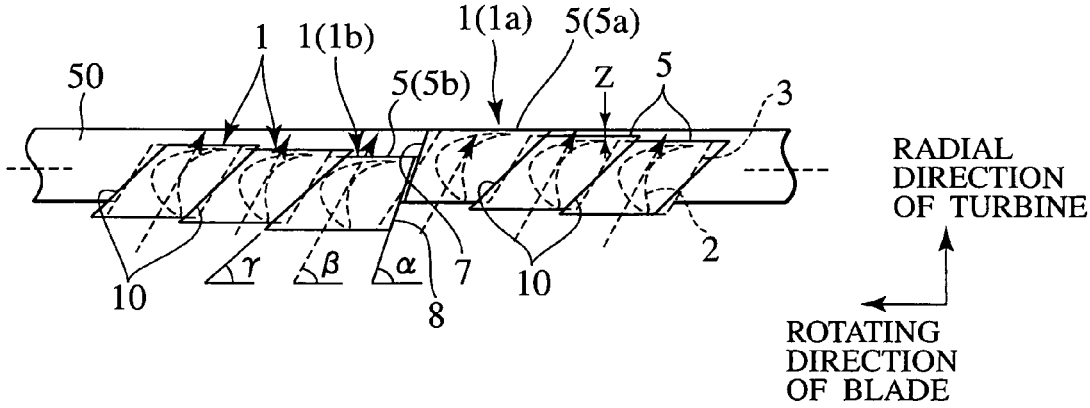
FIG. 2 is a schematic, fragmentary plan view of the turbine rotor blades in the first embodiment being assembled.

FIG. 1 is a fragmentary perspective view of a circular cascade including turbine rotor blades in a first embodiment according to the present invention and FIG. 2 is a schematic, fragmentary plan view of the turbine rotor blades in the first embodiment being assembled. Referring to FIGS. 1 and 2, each of turbine rotor blades (hereinafter referred to simply as "turbine rotor blades") 1 has a blade profile part 2, a base part 3 continuous with the blade profile part 2, a root part 4 to be fitted in one of axial disk grooves 51 successively arranged on the circumference of a rotor disk 50, and integral cover 5 formed integrally with the blade profile part 2 on the outer edge of the blade profile part 2. The root parts 4 of the turbine rotor blades 1 are successively fitted axially in the disk grooves 51 of the rotor disk 50 to form a circular cascade.

Suppose that a positive angle is measured from a first ray parallel to a direction opposite the rotating direction of the turbine rotor blades to a second ray turned backward with respect to the axis of the rotor disk from the first ray. Each disk groove 51 is inclined at a second angle $\beta$ to a direction opposite the rotating direction of the rotor disk 50. The positive second angle $\beta$ is an acute angle between the first ray parallel to the direction opposite the rotating direction of the rotor disk 50 and the second ray turned backward with respect to the axis of the rotor disk 50 from the first ray. Thus a direction in which the turbine rotor blade 1 is moved to fit the root part 4 thereof in the disk groove 51 of the rotor disk 50 is inclined to the axis of the turbine at the complement of the second angle $\beta$, namely, $90°-\beta$. The second angle $\beta$ may be 90° or an obtuse angle.

The root part 4 formed in a shape corresponding to that of the disk groove 51 is provided in its side surface with ridges 6 extending in a direction parallel to the axis of the turbine. The radially outer surface of each ridge 6 inclined so as to slope upward toward the middle, with respect to the rotating direction of the rotor disk 50 of the turbine rotor. The radially outer surfaces of the ridges 6 engage with radially outer surfaces of axial recesses 52 formed in the disk groove 51, respectively, to retain the turbine rotor blade 1 on the rotor disk 50 against centrifugal force that acts on the turbine rotor blade 1 when the turbine rotor rotates.

The front end surface 7 of the integral cover 5 of the leading end turbine rotor blade 1, which will be referred to as "first special turbine rotor blade 1*a*", and the back end surface 8 of the integral cover 5 of the trailing end turbine rotor blade 1, which will be referred to as "second special turbine rotor blade 1*b*" are inclined at a first angle $\alpha$ to a direction opposite the rotating direction of the rotor disk 50. The positive first angle $\alpha$ is an angle between a first ray parallel to the direction opposite the rotating direction of the rotor disk 50 and a second ray turned backward with respect to the axis of the rotor disk 50 from the first ray. The integral covers 5 of the first special turbine rotor blade 1*a* and the second turbine rotor blade 1*b* will be referred to as a leading end integral cover 5*a* and a trailing end integral cover 5*b*, respectively. The first angle $\alpha$ is an acute angle greater than the second angle $\beta$. The first angle $\alpha$ may be 90° or an obtuse angle, provided that the fist angle $\alpha$ is greater than the second angle $\beta$.

The front end surfaces 10 of the integral covers 5, excluding the respective front end surfaces 7 and 8 of the integral covers 5*a* and 5*b*, are inclined at a third angle $\gamma$ to the direction opposite the rotating direction of the rotor disk 50. The third angle $\gamma$ is an acute angle smaller than the second angle $\beta$. The third angle $\gamma$ may be 90° or an obtuse angle, provided that the third angle $\gamma$ is smaller than the second angle $\beta$. The first angle $\alpha$, the second angle $\beta$ and the third angle $\gamma$ are determined so as to meet conditions expressed by: $|\beta-\alpha| \leqq 12°$ and $|\gamma-\beta| \leqq 12°$.

The circumferential length of each integral cover 5 is slightly greater than the geometrical length of the integral cover 5. Therefore, the sum of the circumferential lengths of the integral covers 5 is greater than the circumference of a circle passing joints of the integral covers 5 and the corresponding blade profile parts 2. The geometric length is a length obtained by dividing the circumference of a circle passing joints of the integral covers and the corresponding blade profile parts by the number M of the turbine rotor blades 1.

When the turbine blades 1 are pressed into the disk grooves 51 of the rotor disk 50 after fitting the first special turbine rotor blade 1*a* in the disk groove 51 to assemble the turbine rotor blades 1 and the rotor disk 50, the blade profile parts 2 are twisted and the adjacent integral covers 5 are kept in contact with each other by the resilience of the twisted blade profile parts 2.

A method of assembling the turbine rotor blades 1 in the first embodiment and the rotor disk 50 will be described. The first special turbine rotor blade 1*a* is attached to the rotor disk 50 and then the root parts 4 of the other turbine rotor blades are successively pressed into the disk grooves 51 in order in the direction opposite the rotating direction of the rotor disk 50. The second turbine rotor blade 1*b* is the last turbine rotor blade to be attached to the rotor disk 50. The number of the turbine rotor blades 1 including the first special turbine rotor blade 1*a* and the second special turbine rotor blade 1*b* is M.

First, the root part 4 of the first special turbine rotor blade 1*a*, namely, the first turbine rotor blade, is fitted in the disk groove 51 so that the root part 4 may be fixedly held in place in the disk groove 51. Then, the root part 4 of the second turbine rotor blade 1 is pressed into the disk groove 51 such that the front end surface 8 of the second turbine rotor blade 1 may be in contact with the back end surface 10 of the first special turbine rotor blade 1*a*.

Since the circumferential length of the integral covers 5 is greater than the geometric length of the same, the second turbine rotor blade 1 cannot be pressed into the disk groove 51 to a desired position and the second turbine rotor blade 1 is dislocated slightly forward along the turbine axis relative to the first special turbine rotor blade 1*a* by a distance Z. The distance Z is dependent on the difference P (FIG. 4) between the circumferential length of the integral cover 5 and the geometrical length, the third angle γ at which the back end surface 10 of the first special turbine rotor blade 1*a* and the front end surface of the second turbine rotor blade 1 to the direction opposite the rotating direction, and the second angle β at which the disk groove 51 is inclined to the direction opposite the rotating direction. Then, the respective root parts 4 of the third turbine rotor blade, the fourth turbine rotor blade, . . . the (M−1)th turbine rotor blade and the Mth turbine rotor blade, namely, the second special turbine rotor blade 1*b* are fitted in the grooves 51 successively in that order so that the end surfaces of the adjacent turbine rotor blades 1 are in contact with each other.

The adjacent integral covers 5 of the turbine rotor blades 1 thus attached to the rotor disk 50 by the foregoing assembling steps are in simple contact with each other, and the blade profile parts 2 are neither bent not twisted. After the root part 4 of the second special turbine rotor blade 1*b* has been pressed into the disk groove 51, the other turbine rotor blades 1 excluding the first special turbine rotor blade 1*a* are pressed in a direction parallel to the rotor axis so that those turbine rotor blades are set at the same axial position as the first special turbine rotor blade 1*a* to complete a circular cascade as shown in FIG. 1.

The Mth turbine rotor blade 1, namely, the second special turbine rotor blade 1*b*, is dislocated axially forward by a distance of (M−1)×Z relative to the first turbine rotor blade 1, namely, the first special turbine rotor blade 1*a*. Therefore, the root part 4 of the second special turbine rotor blade 1*b* cannot be inserted in the disk groove 51 if the distance of (M−1)×Z is greater than the length of the disk groove 51. Therefore, the second angle β, the third angle γ and the length of the disk groove 51 need to be determined so that the length of (M−1)×Z is shorter than the length of the disk groove 51.

Figure 3:
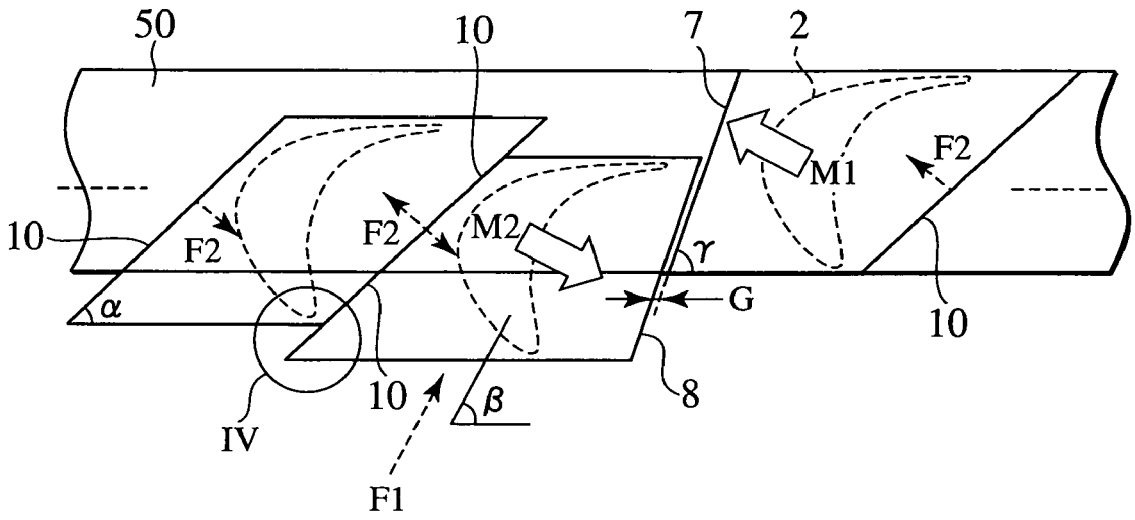
FIG. 3 is a schematic plan view of the turbine rotor blades in the first embodiment at the leading and the trailing end of the circular cascade and the integral cover of a turbine rotor blade contiguous with the back surface of the turbine rotor blade at the trailing end.
Figure 4:
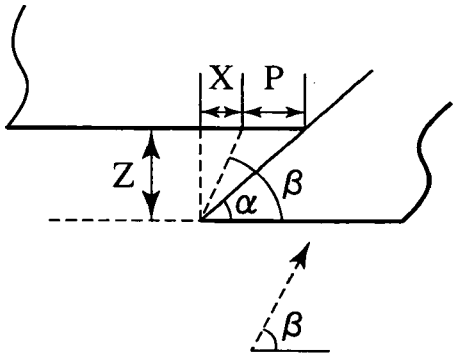
FIG. 4 is an enlarged view of a part indicated at IV in FIG. 3.

FIG. 3 shows the respective integral covers 5 of the first special turbine rotor blade 1*a*, the second special turbine rotor blade 1*b* and the (M−1)th turbine rotor blade 1 adjacent to the front side of the second special turbine rotor blade 1*b*. FIG. 4 is an enlarged view of a part indicated at IV in FIG. 3.

Referring to FIG. 3, when a pressure F1 is applied to the second special turbine rotor blade 1*b* to press the root part of the second special turbine rotor blade 1*b* into the disk groove 51, a reaction force F2 acts on the contiguous end surfaces 10 inclined at the third angle γ of the respective integral covers 5 of the second special turbine rotor blade 1*b* and the turbine rotor blade 1 adjacent to the second special turbine rotor blade 1*b*. Since any constraining force does not act between the front end surface 7 of the integral cover 5 of the first special turbine rotor blade 1*a* and the back end surface 8 of integral cover 5 of the second special turbine rotor blade 1*b*, forces act on the special turbine rotor blades 1*a* and 1*b* to cause bending deformations M1 and M2 in the integral covers 5 of the special turbine rotor blades 1*a* and 1*b*. As the root part 4 of the second special turbine rotor blade 1*b* is inserted deeper into the disk groove 51, the gap G between the front end surface 7 of the integral cover 5 of the first special turbine rotor blade 1*a* and the back end surface 8 of the integral cover 5 of the second special turbine rotor blade 1*b* decreases to zero. Consequently, a constraining force acts between the front end surface 7 of the integral cover 5 of the first special turbine rotor blade 1*a* and the back end surface 8 of integral cover 5 of the second special turbine rotor blade 1*b*, and the bending deformations M1 and M2 remaining after the special turbine rotor blades 1*a* and 1*b* have been attached to the rotor disk 50 are limited to the least extent.

The distance Z of axial dislocation of the integral cover 5 of one of the adjacent turbine rotor blades 1 relative to the integral cover 5 of the other turbine rotor blade is expressed by: $Z=P\times\tan\alpha\times\tan\beta/(\tan\beta-\tan\alpha)$. Thus, the axial displacement $Z_{total}$ of the integral cover 5*b* of the second special turbine rotor blade 1*b* relative to the integral cover 5*a* of the first special turbine rotor blade 1*a* is (M−1)×Z. Therefore, the end surface 10 of the integral cover 5*b* of the second special turbine rotor blade 1*b* and the end surface 10 of the integral cover 5 of the (M−1)th turbine rotor blade 1 opposed to the former end surface 10 can be set in contact with each other and the integral covers 5 can be formed so that the gap G between the opposed end surfaces of the integral covers 5 of the special turbine rotor blades 1*a* and 1*b* can be reduced to zero by properly adjusting the third angle γ at which the end surfaces 7 and 8 are inclined to the direction opposite the rotating direction of the rotor disk 50. The bending deformation of the turbine rotor blades can be limited to the least extent when the root part 4 of the second turbine rotor blade 1*b* is pressed into the disk groove 51 to set the second turbine rotor blade 1*b* in place on the rotor disk 50.

Figure 5:
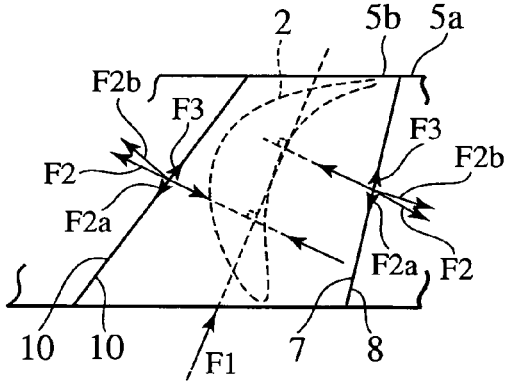
FIG. 5 is a diagram of assistance in explaining forces acting on the turbine rotor blade in the first embodiment at the trailing end when the same turbine rotor blade is attached to a rotor disk.

FIG. 5 is a diagram of assistance in explaining forces that will act on the integral covers 5*a* and 5*b* when the second special turbine rotor blade 1*b* is set in place on the rotor disk 50. When a pressure F1 is applied to the second special turbine rotor blade 1*b* to press the root part 4 of the second special turbine rotor blade 1*b* to a desired position in the disk groove 51, the integral cover 5*b* of the second special turbine rotor blade 1*b* is held between the respective end surfaces 10 and 7 of the integral covers 5 and 5*a* and a reaction force F2 acts on the integral cover 5*b* of the second special turbine rotor blade 1*b* in a direction perpendicular to a direction in which the root part 4 of the second special turbine rotor blade 1*b* is inserted into the disk groove 51. The reaction force F2 can be decomposed into a first component force $F2_a$ acting in a direction parallel to the end surface and a second component force $F2_b$ acting in a direction perpendicular to the end surface.

If a frictional force F3 as a function of the second component force $F2_b$ and coefficient of static friction is higher than the first component force $F2_a$, the second special turbine rotor blade 1*b* can be easily attached to the rotor disk 50 and the root part 4 of the second special turbine rotor blade 1*b* will not come off the disk groove 51 even if the pressure F1 is removed from the second special turbine rotor blade 1*b*. A critical angle meeting such a condition is called a frictional angle. If the coefficient of static friction is 0.2, the frictional angle is 12°. The coefficient of static friction of 0.2 is a general value. If the difference between the first angle α and the second angle β and the difference between the second angle β and the third angle γ are 12° or below, assembling work is facilitated and high reliability can be ensured.

As apparent from the foregoing description, the integral covers 5 of the short turbine rotor blades in the first embodiment can be easily connected to each other with reliability. Since the deformation of the turbine rotor blades can be limited to the least extent, stress that may be induced in the root parts 4 during assembling and after assembling can be reduced and hence high reliability can be ensured.

Figure 6:
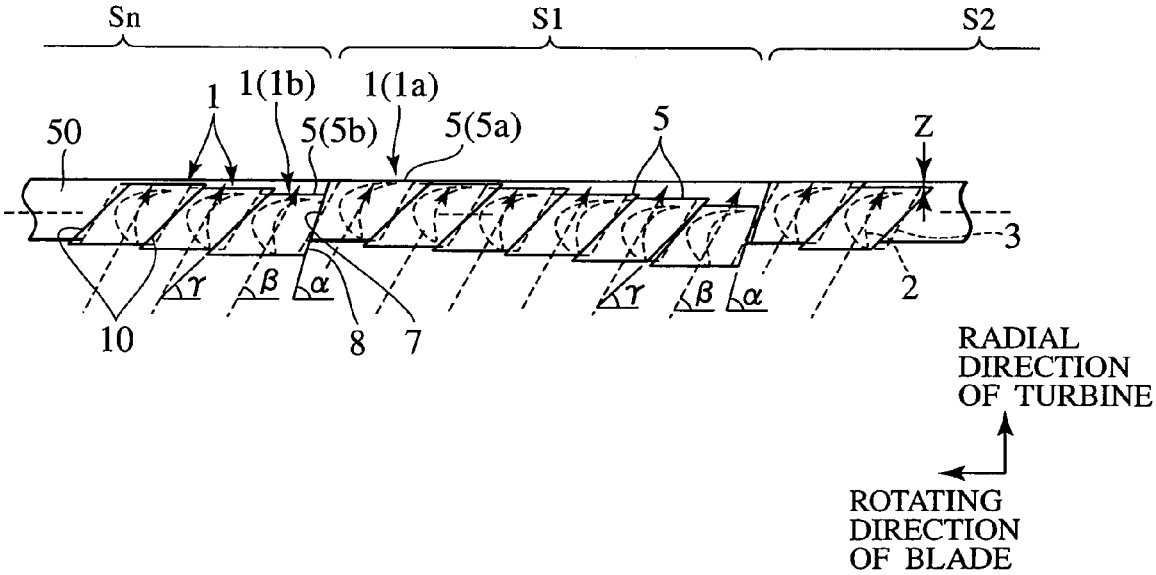
FIG. 6 is a schematic, fragmentary plan view of turbine rotor blades in a second embodiment according to the present invention being assembled.

FIG. 6 shows turbine rotor blades 1 in a second embodiment according to the present invention in an assembling process in a schematic plan view. Parts shown in FIG. 6 like or corresponding to those shown in FIGS. 1 to 5 are denoted by the same reference characters and the description thereof will be omitted. As shown in FIG. 6, the turbine rotor blades 1 are divided into a plurality of sections S1, S2, . . . and Sn. Each of the sections S1 to Sn includes a first special turbine rotor blade 1*a* having a leading-end integral cover 5*a*, and a second special turbine rotor blade 1*b* having a trailing-end integral cover 5*b*.

For example, suppose that a circular cascade has sixty turbine rotor blades 100, and the sixty turbine rotor blades 100 are divided into ten sections each of the six turbine rotor blades 100. Then, each section extends in an angular range of 36° and includes one first special turbine rotor blade 1*a* at the head of the section with respect to the rotating direction of the circular cascade, one second special turbine rotor blade 1*b* at the tail of the section with respect to the rotating direction of the circular cascade, and four turbine rotors 100 arranged between the special turbine rotor blades 1*a* and 1*b*.

The turbine rotor blades are the same in construction as those in the first embodiment. The front end surface 7 of the integral cover 5*a* of the first special turbine rotor blade 1*a* and the back end surface 8 of the integral cover 5*b* of the second special turbine rotor blade 1*b* are inclined at a first angle $\alpha$ to a direction opposite the rotating direction of the rotor, a disk groove in which the root part of each turbine rotor blade is fitted is inclined at a second angle $\beta$ to the direction opposite the rotating direction of the rotor, the end surfaces of the integral covers 5 of the turbine rotor blades excluding the end surfaces 7 and 8 are inclined at a third angle $\gamma$ to the direction opposite the rotating direction of the rotor. The angles meet conditions expressed by: $0<\gamma<\beta<\alpha<180°$, $|\alpha-\beta|\leqq 12°$ and $|\beta-\gamma|\leqq 12°$. Each integral cover 5 has a circumferential length slightly greater than a geometrical length.

A method of assembling the turbine rotor blades 100 in the second embodiment and a rotor disk 50 will be described. Suppose that a circular cascade has sixty turbine rotor blades 100, and the sixty turbine rotor blades 100 are divided into ten sections each of the six turbine rotor blades 100. The first turbine rotor blade 100, namely, the first special turbine rotor blade 1*a*, the second turbine rotor blade 100, the third turbine rotor blade 100, . . . and the sixth turbine rotor blade 100, namely, the second special turbine rotor blade 1*b* of each section are attached successively in that order to the rotor disk 50. There is not any restriction on the order of incorporating the sections S1 to S6 into the rotor disk 50. The sections S1, S2, . . . and S6 may be incorporated in that order, in optional order or simultaneously into the rotor disk 50. However, the first special turbine rotor blade 1*a* needs to be attached to the rotor disk 50 before the second special turbine rotor blade 1*b* of the preceding section. Then, the turbine rotor blades 100 are attached to the rotor disk 50 by the same procedure as that employed in attaching the turbine rotor blades 1 in the first embodiment. The turbine rotor blades 100 of each section are attached sequentially to the rotor disk 50 after attaching the first special turbine rotor blade 1*a* to the rotor disk 50 to complete a circular cascade.

Division of the circular cascade into the plurality of sections each of the turbine rotor blades 100 in the second embodiment provides the following effects in addition to the effects of the first embodiment. When the dimensions of the turbine rotor blades are determined according to the specifications of a turbine and the maximum axial dislocation of $(M-1)\times Z$ of the integral cover is greater than the length of disk grooves 51 formed in the rotor disk 50, the turbine rotor blades cannot be attached to the rotor disk 50. When the turbine rotor blades are divided into n sections, the maximum axial dislocation in each section is $\{(M/n)-1\}\times Z$, which is smaller than $(M-1)\times Z$. Consequently, the degree of freedom of design can be increased and determination of the dimensions of parts can flexibly deal with the specifications of the turbine.

Figure 7:
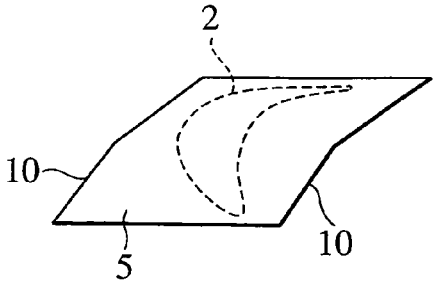
FIG. 7 is a view of another integral cover to be combined with the turbine rotor blade of the present invention.
Figure 8:
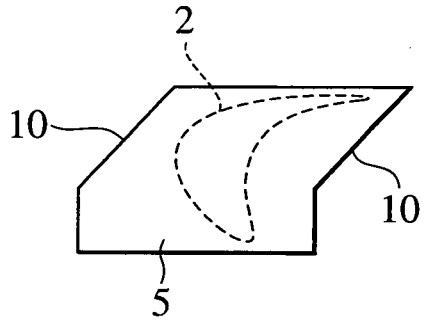
FIG. 8 is a view of a third integral cover to be combined with the turbine rotor blade of the present invention.

Although the integral covers 5 of the turbine rotor blades 1 in the first embodiment and the turbine rotor blades 100 in the second embodiment excluding those of the special turbine rotor blades 1*a* and 1*b* are formed in the shape of a parallelogram, the integral covers 5 may have bent front end and bent back end surface 10 as shown in FIGS. 7 and 8. The bent front end and the bent back end surface 10 may be slopes on the front side with respect to the axis of the rotor axis as shown in FIG. 7 or may be slopes on the back side with respect to the rotor axis as shown in FIG. 8.

Figure 9:
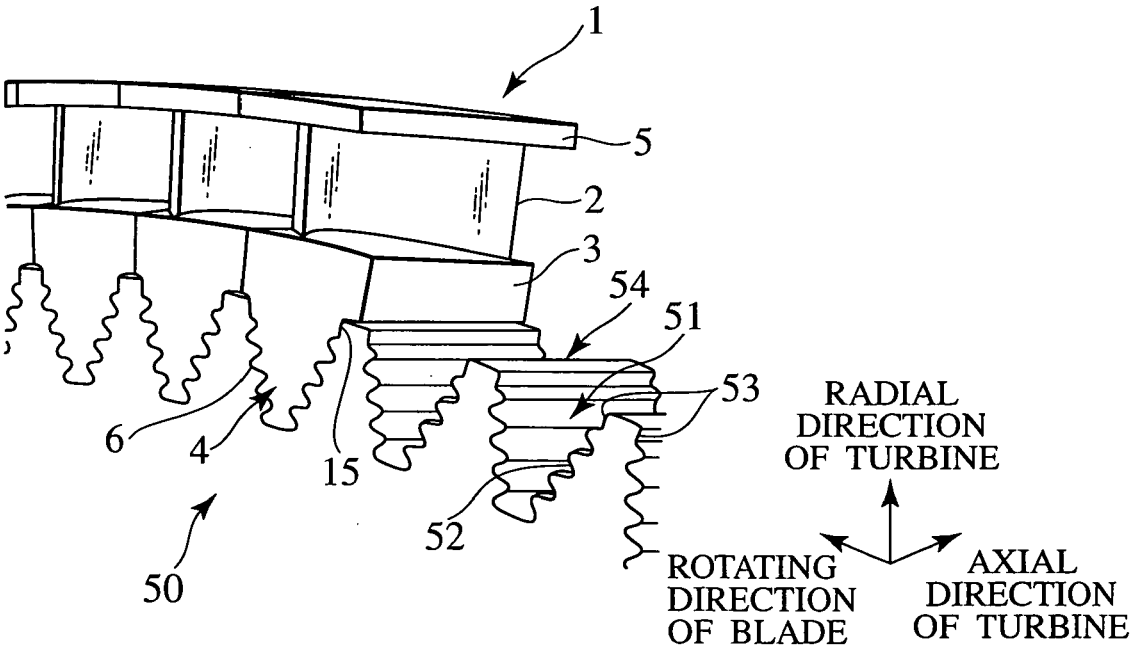
FIG. 9 is a fragmentary perspective view of a circular cascade including turbine rotor blades in a third embodiment according to the present invention.
Figure 10:
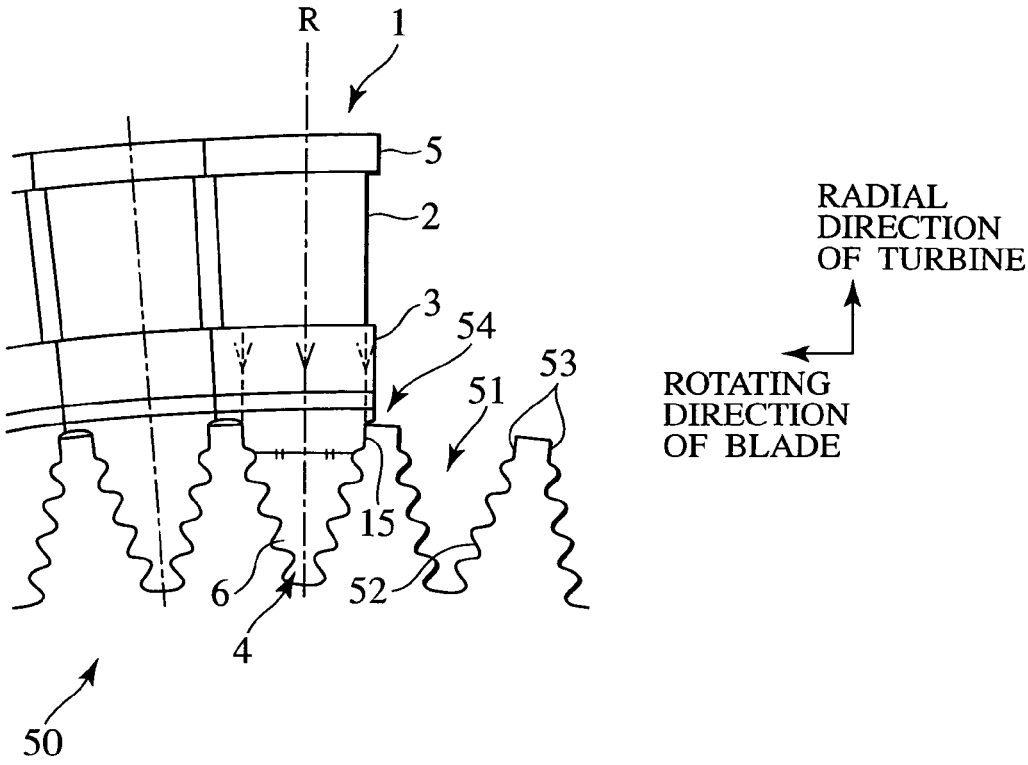
FIG. 10 is a fragmentary end view of the circular cascade including the turbine rotor blades in the third embodiment.

FIG. 9 is a fragmentary perspective view of a circular cascade including turbine rotor blades 1 in a third embodiment according to the present invention and FIG. 10 is a fragmentary end view of the circular cascade including the turbine rotor blades 1 in the third embodiment. The turbine rotor blades 1 in the third embodiment will be described with reference to FIGS. 9 and 10, in which parts like or corresponding to those shown in FIGS. 1 to 8 are denoted by the same reference characters and the description thereof will be omitted.

Referring to FIGS. 9 and 10, the turbine rotor blade 1 in the third embodiment differs from those in the first and the second embodiment in that the root part 4 of the turbine rotor blade 1 has radially outer, radial bearing surfaces 15 to be engaged with radially outer, radial bearing surfaces 53 of a disk groove 51 formed in a rotor disk 50. The radially outer, radial bearing surfaces 15 of the root part 4 and the radially outer, radial bearing surfaces 53 of the disk groove 51 extend in a direction in which the disk groove 51 extends, namely, a direction inclined at a second angle $\beta$ to a direction opposite the rotating direction of the rotor.

The radially outer, radial bearing surfaces 53 are formed on the opposite sides of a tip part 54 of an axial ridge separating the adjacent disk grooves 51. The radially outer, radial bearing surfaces 53 are parallel to a radial plane R passing the middle, with respect to a circumferential direction, of the root part 4. The radially outer, radial bearing surfaces 15 are formed on the front and the back sides of a radially outer end part of the root part 4. The radially outer, radial bearing surfaces 15 are extended parallel to the radial plane R so that the radially outer, radial bearing surfaces 15 engage with the radially outer, radial bearing surfaces 53. The turbine rotor blades 1 in the third embodiment are similar in construction to those in the first and the second embodiment and are attached to the rotor disk 50 by a procedure similar to that for attaching the turbine rotor blades in the first and the second embodiment to the rotor disk.

The turbine rotor blade in the third embodiment has an effect in addition to the effects of the first or the second embodiment. When a bending deformation or a torsional deformation is caused in the turbine rotor blade in the third embodiment during or after the completion of an assembling operation, the root part 4 will not be pressed irregularly to the side surfaces of the disk groove 51 and high stress will not be induced in the turbine rotor blade and the ridge separating the adjacent disk grooves 51 because the radially outer, radial bearing surfaces 15 of the root part 4 are in close engagement with the radially outer, radial bearing surfaces 53 of the disk groove 51. Even if the disk groove 51 is deformed and the exact engagement of the root part 4 in the disk groove 51 is slightly spoiled, only a low stress will be induced in the root part 4 and the ridge separating the adjacent disk grooves 51. Thus the turbine rotor blades have high reliability.

Although the radially outer, radial bearing surfaces 53 of the tip part 54 of the ridge shown in FIGS. 9 and 10 are parallel to the radial plane R, the radially outer, radial bearing surfaces 15 and the radially outer, radial bearing surfaces 53 are effective in reducing stress that may be induced in the root part 4 and the ridge separating the adjacent disk grooves 51 even if the radially outer, radial bearing surfaces 15 and the radially outer, radial bearing surfaces 53 are not exactly parallel to the radial plane R.

Figure 11:
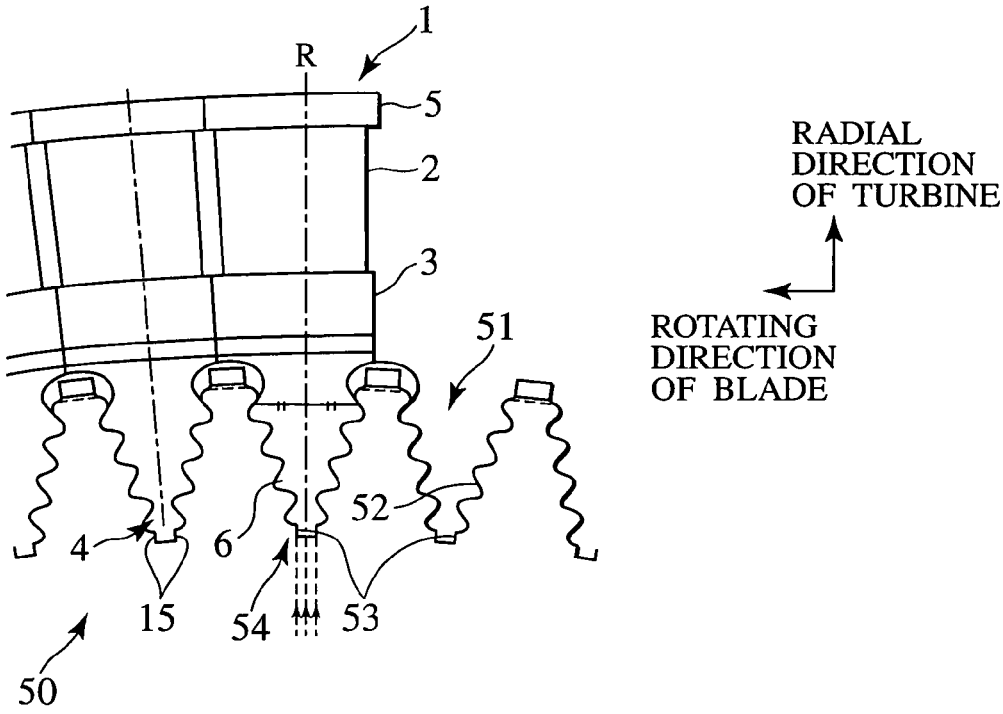
FIG. 11 is a fragmentary end view of a circular cascade including turbine rotor blades in a fourth embodiment according to the present invention.

FIG. 11 is a fragmentary end view of a circular cascade including turbine rotor blades 1 in a fourth embodiment according to the present invention. Parts shown in FIG. 11 having functions like those of the turbine rotor blades shown in FIGS. 1 to 10 are denoted by the same reference characters and the description thereof will be omitted.

Referring to FIG. 11, the turbine rotor blade 1 in the fourth embodiment has a root part 4 having radially inner, radial bearing surfaces 15 to be engaged with radial bottom end bearing surfaces 53 of a disk groove 51 formed in a rotor disk 50. The end bearing surfaces 15 of the root part 4 and the bottom end bearing surfaces 53 of the disk groove 51 extend in a direction in which the disk groove 51 extends, namely, a direction inclined at a second angle β to a direction opposite the rotating direction of the rotor. Whereas the radially outer, radial bearing surfaces 15 of the root part 4 of the turbine rotor blade 1 in the third embodiment are engaged with the radially outer, radial bearing surfaces 53 of a disk groove 51 formed in a rotor disk 50, the end bearing surfaces 15 of the root part 4 of the turbine rotor blade 1 in the fourth embodiment are engaged with the bottom end bearing surfaces 53 of the disk groove 51. The turbine rotor blades 1 in the fourth embodiment are similar in construction to those in the third embodiment and are attached to the rotor disk 50 by a procedure similar to that for attaching the turbine rotor blades in the third embodiment to the rotor disk. Effects of the turbine rotor blades 1 in the fourth embodiment are the same as those of the turbine rotor blades in the third embodiment.

Figure 12:
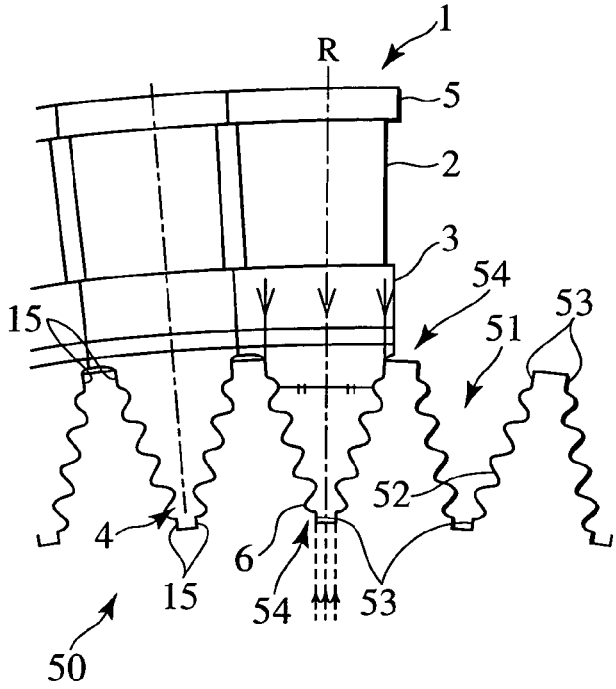
FIG. 12 is a fragmentary end view of a circular cascade including turbine rotor blades in a fifth embodiment according to the present invention.

FIG. 12 is a fragmentary end view of a circular cascade including turbine rotor blades 1 in a fifth embodiment according to the present invention. Parts shown in FIG. 12 having functions like those of the turbine rotor blades shown in FIGS. 1 to 11 are denoted by the same reference characters and the description thereof will be omitted.

Referring to FIG. 12, the turbine rotor blade 1 in the fifth embodiment has a root part 4 having radially outer, radial bearing surfaces 15 to be engaged with radially outer, radial bearing surfaces 53 of a disk groove 51 formed in a rotor disk 50, and radially inner, radial bearing surfaces 15 to be engaged with radially inner, radial bearing surfaces 53 of the disk groove 51. Thus the turbine rotor blade 1 in the fifth embodiment is a combination of the turbine rotor blade in the third embodiment and the turbine rotor blade in the fourth embodiment. The turbine rotor blade 1 in the fifth embodiment is held by both the radially outer end and the radially inner end of the root part 4. The radial, radially outer end and the radially inner, radial bearing surfaces 15 of the root part 4 and the radial, radially outer end and the radially inner, radial bearing surfaces 53 of the disk groove 51 extend in a direction in which the disk groove 51 extends, namely, a direction inclined at a second angle β to a direction opposite the rotating direction of the rotor. The turbine rotor blades 1 in the fifth embodiment are similar in construction to those in the third and the fourth embodiment and are attached to the rotor disk 50 by a procedure similar to that for attaching the turbine rotor blades in the third and the fourth embodiment to the rotor disk. Effects of the turbine rotor blades 1 in the fifth embodiment are the same as those of the turbine rotor blades in the third and the fourth embodiment. The root part 4, having the radially outer end and the tip part engaged with the corresponding bearing surfaces of the disk grove 51, of the rotor 1 in the fifth embodiment can be securely held in the disk groove 51.

Figure 13:
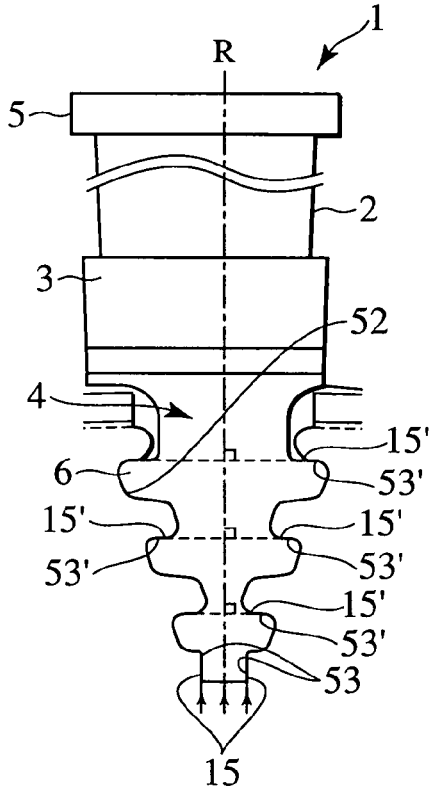
FIG. 13 is an end view of a turbine rotor blade in a sixth embodiment according to the present invention.

FIG. 13 is an end view of a turbine rotor blade 1 in a sixth embodiment according to the present invention. Parts having functions like those of the turbine rotor blades in the foregoing embodiments shown in FIG. 13 are denoted by the same reference characters and the description thereof will be omitted.

Referring to FIG. 13, the root part 4 of the turbine rotor blade 1 is provided on the circumferentially opposite sides thereof with axial ridges 6 each having a radially inner surface substantially perpendicular to the radial plane R and serving as a bearing surface 15'. A disk groove 51 has axial recesses 52 each having a radially outer side surface substantially perpendicular to the radial plane R and serving as a bearing surface 53'. The bearing surfaces 15' of the root part 4 are engaged with the corresponding bearing surfaces 53' of the groove 51, respectively. Whereas the turbine rotor blades 1 in the third to the fifth embodiment are provided with the radial bearing surfaces 15 and the rotor disks are provided with the radial bearing surfaces 53 in engagement with the radial bearing surfaces 15, the turbine rotor blades in the sixth embodiment are provided with the bearing surfaces 15' substantially perpendicular to the radial plane R and engaged with the bearing surfaces 53' substantially perpendicular to the radial plane R. The bearing surface 15' of the root part 4 can be surely kept in surface contact with the bearing surface 53' of the disk groove 51 even if the root part 4 is slightly twisted. Thus irregular contact between the root part 4 and the surfaces of the disk groove 51 can be prevented.

The root part 4 of the turbine rotor blade 1 in the sixth embodiment, similarly to the root part 4 of the turbine rotor blade in the fourth embodiment, has radially inner, radial bearing surfaces 15 to be engaged with radially inner, radial bearing surfaces 53 of the disk groove 51. The root part 4 of the turbine rotor blade 1 in the sixth embodiment may have, similarly to the root part 4 of the turbine rotor blade in the third embodiment, radially outer, radial bearing surfaces 15 to be engaged with radially outer, radial bearing surfaces 53 of the disk groove 51 or may have, similarly to the root part 4 of the turbine rotor blade in the fifth embodiment, both radially outer, radial bearing surfaces 15 and radial, radially inner end bearing surfaces 15. When the bearing surfaces 15' and 53' are capable of sufficiently effectively holding the turbine rotor blade 1 on the rotor disk 50, the radial bearing surfaces 15 and 53 may be omitted. The turbine rotor blades 1 in the sixth embodiment are similar in construction to those in the foregoing embodiments and are attached to the rotor disk 50 by a procedure similar to that for attaching the turbine rotor blades in the foregoing embodiments to the rotor disk.

Needless to say, the turbine rotor blades in the sixth embodiment have effects similar to those of the foregoing embodiments. The bearing surfaces 15' and 53' parallel to the radial plane R can surely prevent the irregular contact between the root part 4 and the surfaces of the disk groove 51 even if the root part 4 is twisted slightly and the radial bearing surfaces 15 of the root part 4 and the radial bearing surfaces 53 of the groove 51 come into slightly irregular contact. Thus the turbine rotor blades ensure high reliability.

Figure 14:
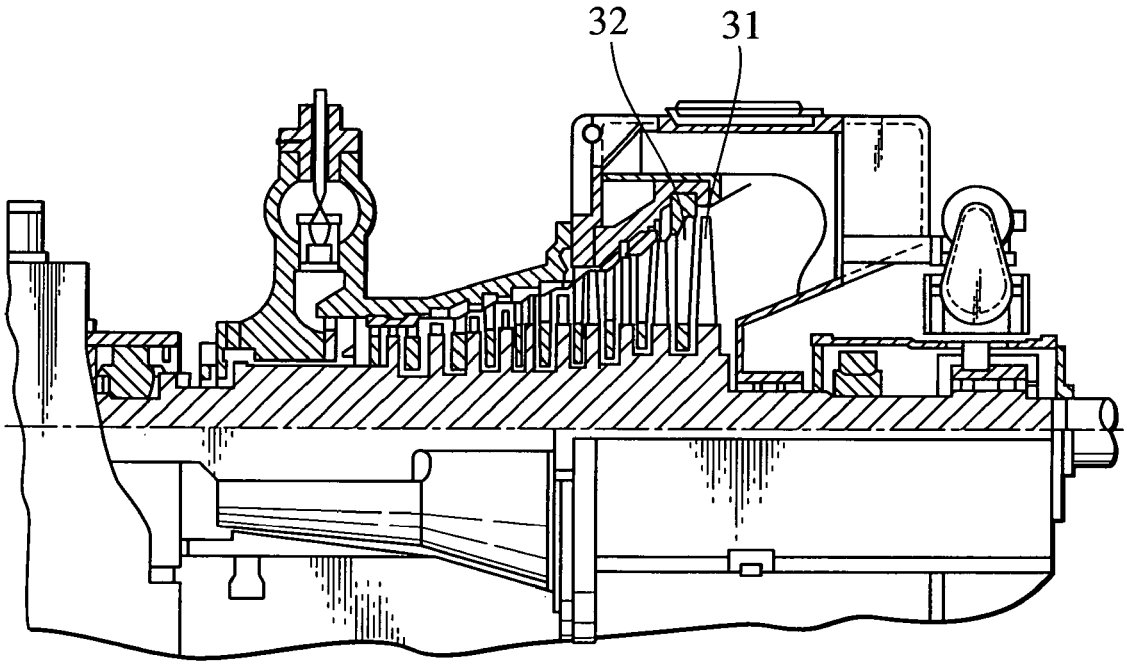
FIG. 14 is a partly cutaway side elevation of a turbine provided with the turbine rotor blades of the present invention.

FIG. 14 is a partly cutaway side elevation of a turbine to which the turbine rotor blades in the foregoing embodiments are applied. Referring to FIG. 14, circular rotor cascades 31 formed by attaching the turbine rotor blades of the present invention to rotor disks and circular stationary cascades 32 formed by attaching stationary blades in circular arrangements to the inside surface of a stationary member, such as a casing, are arranged axially alternately on a rotor shaft. The turbine has a plurality of stages each including one of the rotor cascades 31 and the stationary cascade 32 adjacent to the rotor cascade 31. FIG. 14 shows a steam turbine as an example of the turbine provided with the turbine rotor blades of the present invention. Naturally, the turbine rotor blades of the present invention are applicable to gas turbines. Although the short turbine rotor blades of the present invention are applicable to either of a rotor cascade for a high-pressure stage and a rotor cascade for a low-pressure stage, the short turbine rotor blades of the present invention are particularly effective when applied to a cascade for a high-pressure stage.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A set of turbine rotor blades arranged in a circular cascade on a rotor disk, each having a blade profile part, a root part to be fitted axially in one of a plurality of axial disk grooves formed in the rotor disk in a circumferential arrangement, and an integral cover formed integrally with the blade profile part at the outer edge of the blade profile part;

wherein a front end surface, faced in a direction in which the rotor disk rotates, of the integral cover of each turbine rotor blade is inclined to a direction in which the root part of the turbine rotor blade is fitted in the disk groove of the rotor disk, the sum of circumferential lengths of the integral covers of the turbine rotor blades is greater than a circumference of a circle passing positions at which the integral covers are attached to the outer edges of the blade profile parts, and the adjacent integral covers are brought into firm contact with each other by the resilience of the blade profile parts which are twisted when the root parts of the turbine rotor blades are fitted axially in the disk grooves of the rotor disk.

2. The set of turbine rotor blades according to claim 1, wherein a positive angle is measured from a first ray parallel to a direction opposite the rotating direction of the rotor disk to a second ray turned backward with respect to the axis of the rotor disk from the first ray, a front end surface, faced in a direction in which the rotor disk rotates, of the integral cover of at least the leading end turbine rotor blade a back end surface of the integral cover of the trailing end turbine rotor blade adjacent to the leading end turbine rotor blade are inclined at a first angle to the rotating direction of the rotor disk, the grooves are inclined at a second angle to the rotating direction of the rotor disk, and the first angle is greater than the second angle.

3. The set of turbine rotor blades according to claim 2, wherein front end surfaces, excluding the front end surface inclined at the first angle to the rotating direction of the rotor disk, of the integral covers are inclined at a third angle to the rotating direction of the rotor disk, and the third angle is smaller than the second angle.

4. The set of turbine rotor blades according to claim 3, wherein the first angle is an acute angle.

5. The set of turbine rotor blades according to claim 4, wherein the difference between the first and the second angle and the difference between the second and the third angle are 120° or below.

6. The set of turbine rotor blades according to claim 2, wherein the circular cascade is divided into a plurality of section each having the plurality of turbine rotor blades including the leading end turbine rotor blade and the trailing end turbine rotor blade.

7. The set of turbine rotor blades according to claim 1, wherein the root part of each turbine rotor blade is provided on the circumferentially opposite sides thereof with radially outer, radial bearing surfaces to be engaged with radially outer, radial bearing surfaces formed in the disk groove of the rotor disk.

8. The set of turbine rotor blades according to claim 7, wherein the radial bearing surfaces are parallel to a direction in which the disk groove extends.

9. The set of turbine rotor blades according to claim 1, wherein the root part of each turbine rotor blade is provided on the circumferentially opposite sides thereof with radially inner, radial bearing surfaces to be engaged with radially inner, radial bearing surfaces formed in the disk groove of the rotor disk.

10. The set of turbine rotor blades according to claim 1, wherein the root part of each turbine rotor blade is provided on the circumferentially opposite sides thereof with radially inner, radial bearing surfaces and radially outer, radial bearing surfaces to be engaged respectively with radially inner, radial bearing surfaces and radially outer, radial bearing surfaces formed in the disk groove of the rotor disk.

11. The set of turbine rotor blades according to claim 1, wherein the root part of each turbine rotor blade is provided on the circumferentially opposite sides thereof with axial ridges each having a radially inner bearing surface substantially perpendicular to a radial direction, and the disk groove has axial recesses each having a radially outer bearing surface, with which the radially inner bearing surface of the root part is engaged, substantially perpendicular to a radial direction.

12. A turbine comprising circular rotor cascades each formed by attaching turbine rotor blades each having a blade profile part, a root part to be fitted axially in one of a plurality of axial disk grooves formed in a rotor disk in a circumferential arrangement, and an integral cover formed integrally with the blade profile part at the outer edge of the blade profile part to the rotor disk;

wherein a front end surface, faced in a direction in which the rotor disk rotates, of the integral cover of each turbine rotor blade is inclined to a direction in which the root part of the turbine rotor blade is fitted in the disk groove of the rotor disk, the sum of circumferential lengths of the integral covers of the turbine rotor blades is greater than a circumference of a circle passing positions at which the integral covers are attached to the outer edges of the blade profile parts, and the adjacent integral covers are brought into firm contact with each other by the resilience of the blade profile parts which are twisted when the turbine rotor blades are fitted axially in the disk grooves of the rotor disk.

13. A set of turbine rotor blades arranged in a circular cascade on a rotor disk, each having a blade profile part, a root part to be fitted axially in one of a plurality of axial disk grooves formed in the rotor disk in a circumferential arrangement, and an integral cover formed integrally with the blade profile part at the outer edge of the blade profile part;

wherein, a positive angle is measured from a first ray parallel to a direction opposite the rotating direction of the rotor disk to a second ray turned backward with respect to the axis of the rotor disk from the first ray, a front end surface, faced in a direction in which the rotor disk rotates, of the integral cover of at least one leading end turbine rotor blade among the turbine rotor blades and a back end surface of the integral cover of the trailing end turbine rotor blade adjacent to the leading end turbine rotor blade are inclined at a first angle to the rotating direction of the rotor disk, the grooves are inclined at a second angle to the rotating direction of the rotor disk, the first angle is greater than the second angle, end surfaces, excluding the front and the back end surface inclined at the first angle to the rotating direction of the rotor disk, of the integral covers are inclined at a third angle to the rotating direction of the rotor disk, the third angle is smaller than the second angle, the sum of circumferential lengths of the integral covers of the turbine rotor blades is greater than a circumference of a circle passing positions at which the integral covers are attached to the outer edges of the blade profile parts, and the adjacent integral covers are brought into firm contact with each other by the resilience of the blade profile parts which are subject to torsional deformation when the second and the following turbine rotor blades are fitted axially in the disk grooves of the rotor disk.

* * * * *